US008092971B2

(12) United States Patent
Kayamoto et al.

(10) Patent No.: US 8,092,971 B2
(45) Date of Patent: Jan. 10, 2012

(54) RESIN-COATED CARRIER FOR ELECTROPHOTOGRAPHIC DEVELOPER AND PROCESS FOR PRODUCING THE SAME, AND ELECTROPHOTOGRAPHIC DEVELOPER COMPRISING THE RESIN-COATED CARRIER

(75) Inventors: Kanao Kayamoto, Kashiwa (JP); Hironori Hojo, Kashiwa (JP); Toshio Honjo, Kashiwa (JP)

(73) Assignee: Powdertech Co., Ltd., Kashiwa-Shi, Chiba (JP)

( * ) Notice: Subject to any disclaimer, the term of this patent is extended or adjusted under 35 U.S.C. 154(b) by 814 days.

(21) Appl. No.: 10/584,066

(22) PCT Filed: Nov. 25, 2004

(86) PCT No.: PCT/JP2004/017452

§ 371 (c)(1),
(2), (4) Date: Jun. 22, 2006

(87) PCT Pub. No.: WO2005/062132

PCT Pub. Date: Jul. 7, 2005

(65) Prior Publication Data

US 2007/0154833 A1 Jul. 5, 2007

(30) Foreign Application Priority Data

Dec. 22, 2003 (JP) ..... 2003-424672

(51) Int. Cl.
*G03G 9/113* (2006.01)

(52) U.S. Cl. ..... 430/137.13; 430/111.31

(58) Field of Classification Search ..... 430/111.31, 430/137.13

See application file for complete search history.

(56) References Cited

U.S. PATENT DOCUMENTS

| | | | | |
|---|---|---|---|---|
| 6,506,531 | B1 * | 1/2003 | Hakata et al. | 430/111.33 |
| 2002/0172884 | A1 * | 11/2002 | Kayamoto et al. | 430/111.41 |
| 2003/0177867 | A1 * | 9/2003 | Hultman et al. | 75/349 |
| 2003/0186156 | A1 | 10/2003 | Kayamoto et al. | |
| 2005/0214671 | A1 * | 9/2005 | Mizutani et al. | 430/111.35 |

FOREIGN PATENT DOCUMENTS

| | | | |
|---|---|---|---|
| JP | 7-234548 | A | 9/1995 |
| JP | 8-202084 | A | 8/1996 |
| JP | 2000-267443 | A | 9/2000 |
| JP | 2001-27828 | A | 1/2001 |
| JP | 2002-91092 | A | 3/2002 |
| JP | 2003-156887 | A | 5/2003 |

* cited by examiner

*Primary Examiner* — Christopher Rodee
*Assistant Examiner* — Rachel Zhang
(74) *Attorney, Agent, or Firm* — Rothwell, Figg, Ernst & Manbeck, P.C.

(57) ABSTRACT

An object of the present invention is to provide a resin-coated ferrite carrier comprising a carrier core material having a small particle size, a high sphericity and surface uniformity, and a low standard deviation, a process for producing the carrier, and an electrophotographic developer comprising the resin-coated ferrite carrier and having a high image quality and excellent durability. For achieving the above object, there is provided a resin-coated carrier for an electrophotographic developer characterized by comprising spherical ferrite particles having an average particle size of 20 to 50 μm, a surface uniformity of 90% or more, an average sphericity of 1 to 1.3 and a sphericity standard deviation of 0.15 or less, a process for producing the carrier, and an electrophotographic developer comprising the resin-coated carrier.

3 Claims, 1 Drawing Sheet

RESIN-COATED CARRIER FOR ELECTROPHOTOGRAPHIC DEVELOPER AND PROCESS FOR PRODUCING THE SAME, AND ELECTROPHOTOGRAPHIC DEVELOPER COMPRISING THE RESIN-COATED CARRIER

CROSS REFERENCE TO RELATED APPLICATION

This application is a 35 USC §371 National Phase Entry Application from PCT/EP2004/017452, filed Nov. 25, 2004, and designating the United States.

TECHNICAL FIELD

The present invention relates to a resin-coated carrier for an electrophotographic developer which has a small particle size, a high surface uniformity and average sphericity, and a low sphericity standard deviation, and a process for producing the same, and an electrophotographic developer comprising the resin-coated carrier and having high image quality and excellent durability.

BACKGROUND ART

Two-component developers used in electrophotography are composed of a toner and a carrier. The carrier is a carrier material which is mixed and stirred with the toner in a developer box to impart a desired charge to the toner, and carries the charged toner to electrostatic latent images on a photoreceptor to form toner images. The carrier, also after forming the toner images, is held on a magnet, remains on a development roll, further again returns to the developer box, is again mixed and stirred with new toner particles, and is repeatedly used in a certain period.

The two-component developers, different from one-component developers, are ones in which a carrier stirs toner particles and imparts a desired chargeability to the toner particles while having a function of transporting the toner, thus having good controllability in developer design. Therefore, the two-component developers are widely used especially in the fields of full-color machines requiring high-quality images, and high-speed machines requiring reliability and durability of image sustainability.

For obtaining high-quality images in these two-component electrophotographic developers, ferrite particles such as a Cu—Zn ferrite or Ni—Zn ferrite are used as a carrier in place of an oxide-filmed iron powder and a resin-coated iron powder. Ferrite carriers using these ferrite particles have many advantageous characteristics to obtain high-quality images, such as generally spherical and controllable in magnetic properties, over conventional iron powder carriers. Further, resin-coated ferrite carriers in which the ferrite particles as a core material are coated with various resins are improved in wear resistance, durability, etc., and controllable in volume specific resistance.

However, since the ferrite is a ceramic, it has a drawback of smashing by impact though having a high hardness after the ferrite reaction. In the sintering step in production where the ferrite reaction is made to occur, gaps between particles become small especially with decreasing particle size, and particles themselves fuse by heating in a high temperature, thereby becoming difficult to maintain a spherical shape.

In resent years, in such two-component electrophotographic developers, the high-speed and full-color imaging of the development performance has strongly been demanded.

For obtaining a high-quality image output in such a demand, a problem of making carriers and toners of small particle sizes arises.

Regarding toners, various toners having small particle sizes and sharp particle distributions by polymer toner technologies, etc., have been proposed.

On the other hand, making a carrier of a small particle size, that is, use of small particle-sized ferrite particles makes a formed magnetic brush soft, and makes the specific surface area of the carrier large and the held toner amount large, resulting in anticipation of large effects on image qualities such as the image density, fogging in image, toner scattering and gradation.

However, making ferrite carriers of small particle sizes raises a problem, in the production steps, of making it difficult to maintain a spherical shape of the ferrite particles as described above. Although for improving the wear resistance and the durability, the surface of the carrier core material (ferrite particle) is coated with various kinds of resins as described above, if the shape of the ferrite particles is impaired, the coating nonuniformity and exposed parts of the core material are generated at the time of resin-coating. Thus, the carrier performance is not fully achieved, and the high-quality image and the elongated life (high durability) required for developers are not accomplished.

In the production steps of ferrite particles, when particles are shredded in the shredding step after sintering, if fused particles are shredded by strong impacts, they are thoroughly crushed, and amorphous particles come to mingle. Amorphous particles are difficult to remove, so if the resin-coating is performed with the amorphous particles in the next step, the image quality is adversely affected due to uniform coating not being formed on the amorphous particles, interfering with fluidity, etc.

Although for maintaining a spherical shape, fusion between particles is prevented by lowering the sintering temperature, the carrier core material becomes porous, and in the resin-coating step for the carrier core material surface, the resin penetrates inside, thereby being liable to cause variations in carrier performances.

Sintering to form ferrites conventionally involves filling raw materials in a sagger of alumina, etc., and sintering in a tunnel-type sintering furnace. However, with a small particle size, since fusion between particles is easily generated, the sintering temperature cannot be too much raised, thereby causing variations in the surface property. This results in an obstacle to the uniform coating formation in the next resin-coating step, and leads to the performance deterioration.

The technology to produce ferrite particles having a spherical shape, a uniform surface property and a small particle size has not been sufficient as described above. For achieving the high-quality and the elongated life when a two-component developer is prepared with a toner, various attempts have been made to provide a ferrite carrier having a small particle size, a spherical shape and a uniform surface property.

Patent Document 1 (Japanese Patent Laid-Open No. 07-98521) describes a carrier for electrophotography having a 50% average particle size ($D_{50}$) of 15 to 45 μm, a specified particle distribution and a definite ratio of specific surface areas by different measuring methods.

Patent Document 2 (Japanese Patent Laid-Open No. 2001-117285) describes a carrier for developing electrostatic charge images which uses nucleus particles (carrier core material) having a volume average particle size of 25 to 50 μm and a volume resistance and a shape index within definite ranges, and which has a coating layer containing electroconductive particles formed on the nucleus particle surface.

Patent Document 3 (Japanese Patent Laid-Open No. 08-292607) describes a two-component developer wherein a coating layer composed of a resin material is formed on the surface of carrier core material particles, and wherein the shape indexes of the carrier core material particles and the carrier particles after resin-coating are specified, and the former shape index is constituted to be larger than the latter shape index.

Patent Document 4 (Japanese Patent Laid-Open No. 09-197722) describes a carrier for developing electrostatic charge images obtained by forming a coating layer on nucleus particles (carrier core material) which have a saturation magnetization of 50 to 70 $Am^2/kg$, an average particle size of 30 to 40 μm, a weight ratio of not more than 22 μm of 2.0 to 17.0 wt %, and a specified shape index.

Patent Document 5 (Japanese Patent Laid-Open No. 02-255539) describes a process for producing a ferrite powder comprising a wet mixing step for raw powders, an atomizing step to adjust the particle size to 10 μm to 100 μm, and a stirring and sintering step at 1,100° C. to 1,200° C. in this order to obtain ferrite powder. It contends that in this production process, the production steps are simplified, and since the obtained ferrite powder is of a spherical shape, and has a small specific surface area in comparison with amorphous powders, the improvement in the dispersibility and the fluidity are achieved.

Although the inventions according to the Patent Documents 1 to 4 described above make the ferrite carrier core materials of small particle sizes, specify the shape indexes, the specific surface area, etc., and provide mainly spherical ferrite core materials, a carrier core material which has a small particle size, and yet a high sphericity and surface uniformity, and a low standard deviation, a resin-coated ferrite carrier using the carrier core material, and a process for producing the same, are not obtained. The Patent Document 5 describes a simplified process for producing a ferrite powder, and only shows that the obtained ferrite powder is of a spherical shape.

[Patent Document 1]: Japanese Patent Laid-Open No. 07-98521

[Patent Document 2]: Japanese Patent Laid-Open No. 2001-117285

[Patent Document 3]: Japanese Patent Laid-Open No. 08-292607

[Patent Document 4]: Japanese Patent Laid-Open No. 09-197722

[Patent Document 5]: Japanese Patent Laid-Open No. 02-255539

Accordingly, an object of the present invention is to provide a resin-coated ferrite carrier using a carrier core material having a small particle size, a high sphericity and surface uniformity, and a low standard deviation, a process for producing the same, and an electrophotographic developer using the resin-coated ferrite carrier and having high-quality images and an excellent durability.

DISCLOSURE OF THE INVENTION

As a result of extensive studies to solve the problems described above, the present inventors have found that the above object can be achieved by sintering ferrite particles at a certain temperature or more while making them to flow by a fluidizing means. This finding has led to the completion of the present invention.

That is, the present invention provides a resin-coated carrier for an electrophotographic developer, characterized by comprising spherical ferrite particles having an average particle size of 20 to 50 μm, a surface uniformity of 90% or more, an average sphericity of 1 to 1.3 and a sphericity standard deviation of 0.15 or less.

In the above resin-coated carrier, the above spherical ferrite particles preferably have a surface uniformity of 92 to 100% and a sphericity standard deviation of 0.125 or less.

In the above resin-coated carrier, the above spherical ferrite particles have an apparent density of 2.0 to 2.5 $g/cm^3$, a magnetization of 40 to 80 $Am^2/kg$ in the magnetic field of 79.5 A/m, and a scattered material magnetization 80% or more of a main body magnetization.

The present invention provides a process for producing a resin-coated carrier for an electrophotographic developer, characterized by that in the process for producing the resin-coated carrier for an electrophotographic developer wherein ferrite raw materials are weighed, mixed, then crushed; the obtained slurry is granulated, then sintered, and coated with a resin, the sintering is performed at a sintering temperature of 1,200° C. or more while the granules are made to flow by a fluidizing means.

In the above production process, the above sintering temperature is preferably 1,200 to 1,400° C., and the sintering time is preferably 0.1 to 5 h.

In the above production process, before the above sintering, the above granules are preferably pre-sintered at 500 to 700° C. for 0.1 to 5 h.

In the above production process, the above sintering is preferably performed by a rotary sintering furnace, i.e., a rotary kiln.

In the above rotary sintering furnace (rotary kiln), preferably, the retort rotation speed is 0.5 to 10 rpm; the retort inclination is 0.5 to 4.0°; the inlet hammering frequency is 10 to 300 times/min; and the outlet hammering frequency is 10 to 300 times/min.

Further, the present invention provides an electrophotographic developer comprising the resin-coated carrier and a toner.

The resin-coated carrier for an electrophotographic developer according to the present invention is one in which a carrier core material having a small particle size, a high sphericity and surface uniformity, and a low standard deviation is coated with a resin, and which has no coating nonuniformity and no exposed parts of the core material and little carrier scattering. Besides, the production process according to the present invention allows the above resin-coated carrier to be produced in a stable productivity. Further, the electrophotographic developer according to the present invention, since the above resin-coated carrier is used, is of a high-quality image and excellent in durability.

DESCRIPTION OF SYMBOLS

Figure 1:
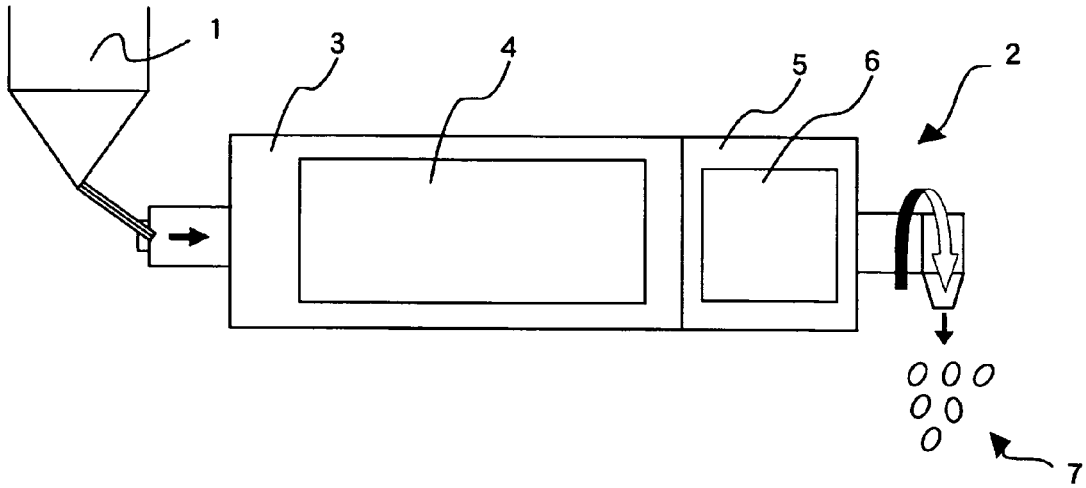
FIG. 1 is an illustrative diagram showing a sintering step used in a production process according to the present invention.

1: granules feeding apparatus
2: rotary kiln,
3: hot section,
4: heater,
5: cooling section,
6: cooling medium,
7: sintered material (spherical ferrite particles)

BEST MODE FOR CARRYING OUT THE INVENTION

Hereinafter, the best mode for carrying out the present invention will be described.

<A Resin-Coated Carrier for an Electrophotographic Developer According to the Present Invention>

In a resin-coated carrier for an electrophotographic developer according to the present invention, the composition of spherical ferrite particles used as the carrier core material is not especially limited, but preferably is one expressed by the following formula (1):

$$(MnO)x(MgO)y(Fe_2O_3)z \quad (1)$$

wherein x+y+z=100 mol %, x=35 to 45 mol %, y=5 to 15 mol %, z=40 to 55 mol %.

Part of (MnO) and/or (MgO) in the above formula (1) may be substituted with at least one kind of oxides selected from SrO, $Li_2O$, CaO, TiO, CuO, ZnO and NiO.

A ferrite of such a specified composition, since having a high magnetization and a high uniformity of magnetization (little variation in magnetization), is preferably used in the present invention.

The average particle size of the spherical ferrite particle according to the present invention is 20 to 50 μm, preferably 25 to 40 μm. With the average particle size of less than 20 μm, the carrier adhesion is liable to occur, causing white spots. With that exceeding 50 μm, the image quality becomes coarse, hardly providing a desired resolution.

The surface uniformity of the spherical ferrite particle according to the present invention is 90% or more, preferably 92 to 100%. With the surface uniformity of less than 90%, the uniformity of the ferrite particle surface is inferior. Here, the surface uniformity denotes one obtained as follows:

(1) A carrier core material is photographed by a SEM (scanning electron microscope) at a magnification of ×200 by shifting the visual field so that the total number of more than 200 particles can be counted.

(2) The carrier core material whose surface has a smooth part occupying a half or more of the surface is visually checked.

(3) One hundred particles of the carrier core material are checked, and the percentage content of the carrier core material shown in the above (2) is calculated.

The average sphericity of the spherical ferrite particles of the present invention is 1 to 1.3, preferably 1 to 1.25. With the average sphericity exceeding 1.3, the sphericity of the ferrite particles is impaired. Here, the average sphericity denotes one as follows:

(1) A carrier core material is photographed by a SEM at a magnification of ×300 by shifting the visual field so that the total number of more than 100 particles can be counted.

(2) SEM images are read by a scanner; the image analysis is conducted using an image analyzer soft (Image-Pro PLUS, manufactured by Media Cybernetics Inc.); and the circumscribed circle diameter and the inscribed circle diameter of each particle are determined, and the sphericity is let denote the ratio. If the two diameters are equal, the ratio is 1, and in the case of a true sphere, the ratio is 1.

(3) The average sphericity and its standard deviation are calculated from the sphericities determined for 100 particles.

The sphericity standard deviation is 0.15 or less, preferably 0.125 or less. With the sphericity standard deviation exceeding 0.15, the deviation width of the ferrite shape becomes large, causing variations in the coating state at resin-coating.

The apparent density of the spherical ferrite particle according to the present invention is preferably 2.0 to 2.5 g/cm$^3$; the magnetization thereof in the magnetic field of 79.5 A/m is preferably 40 to 80 Am$^2$/kg; and the scattered material magnetization thereof is preferably 80% or more of the main body magnetization. With these properties, a developer obtained in combination with a toner provides good image properties and the like.

In the carrier for an electrophotographic developer according to the present invention, the above spherical ferrite particles are used as the carrier core material, and the surface of the particles is coated with a resin. The surface of the carrier core material is coated with a resin for improving the durability and obtaining stable image properties in a long period. As the coating resin, various kinds of resins conventionally known are usable. They include, for example, a fluororesin, acrylic resin, epoxide resin, polyester resin, fluoroacrylic resin, acryl-styrene resin, silicone resin, and a modified silicone resin modified by a resin such as an acrylic resin, polyester resin, epoxide resin, alkyd resin, urethane resin or fluororesin.

The coating amount of the resin is preferably 0.1 to 4.0 wt % to the carrier core material, further preferably 0.5 to 3.0 wt %. With the coating amount of less than 0.1 wt %, a uniform coating layer is hardly formed on the carrier surface. By contrast, with that exceeding 4.0 wt %, aggregation of the carrier itself occurs, causing the decrease in productivity including decrease in yield, and the variations in the developer properties such as fluidity and charge quantity in actual machines.

In the above coating resin, a silane coupling agent can be contained as a charge control agent. This is because although the charging capability sometimes decreases when the coating is controlled such that the core material-exposed area is made to be relatively small, addition of a silane coupling agent makes it controllable. The kind of a coupling agent to be used is not especially limited, but for a negative polarity toner, an aminosilane coupling agent is preferable, and for a positive polarity toner, a fluorosilane coupling agent is preferable.

Further, electroconductive microparticles can be added to the coating resin. This is because when the coating is controlled such that the coating resin amount is made to be relatively large, the absolute resistance becomes too high, sometimes decreasing the developing power. However, since the electroconductive microparticles themselves have low resistance in comparison with those of the coating resin and the ferrite as the core material, too much addition thereof causes a rapid charge leakage, the addition amount is 0.25 to 20.0 wt % to the solid content of the coating resin, preferably 0.5 to 15.0 wt %, especially preferably 1.0 to 10.0 wt %. The electroconductive microparticles include an electroconductive carbon, an oxide such as titanium oxide or tin oxide, and an oxide of various organic electroconductive agents, etc.

<A Process for Producing a Resin-Coated Carrier for an Electrophotographic Developer According to the Present Invention>

In a process for producing a resin-coated carrier for an electrophotographic developer according to the present invention, first, ferrite raw materials are weighed in a prescribed composition, and thereafter crushed and mixed in a ball mill, vibration mill or the like for 0.5 h or more, preferably for 1 to 20 h. Water is added to crushed material thus obtained to make it slurry-like, and the slurry is granulated by using a spray drier. Next, the granules are calcined, and thereafter crushed to obtain a slurry. The slurry is again granulated by a spray drier to obtain spherical granules. The calcination step, when the apparent density is desired to be reduced, may be omitted.

In the production process according to the present invention, after the spherical granules are dried, they are sintered at a temperature of 1,200° C. or more while being made to flow by a fluidizing means. By sintering the granules while making them flow by a fluidizing means, not only the particles can be uniformly heated, and the surface is made uniform, but also the ferritization reaction is made homogeneous, and the magnetic property distribution becomes sharp. Therefore, this is effective for solving a drawback of the carrier scattering in a small particle size carrier.

Also in shredding after sintering, although when granules are sintered with the particles charged with a sagger as conventionally done, the shredding becomes difficult because the particles are made to be block-like after sintering due to bonding between the particles, bonding between the particles becomes little by sintering while making the granules flow using a fluidizing means, whereby the shredding becomes easy. Ferrites are weak in impacts like ceramics, so if the stress of the shredding step is strong, crack and chipping occur. Therefore, making the stress during the shredding step to a minimum is very important.

The sintering temperature is 1,200° C. or more as described above, preferably 1,200 to 1,400° C., further preferably 1,250 to 1,350° C.; and the sintering time is preferably 0.1 to 10 h, further preferably 0.1 to 8 h, most preferably 0.1 to 6 h. With the sintering temperature of less than 1,200° C., a sufficient ferritization reaction does not occur. The sintering time of less than 0.1 h does not generate a sufficient ferritization reaction, and the sintering time exceeding 10 h is economically wasteful. As the sintering atmosphere, a nitrogen gas atmosphere containing a certain amount of oxygen gas is preferably employed.

As a fluidizing means, a rotary sintering furnace, i.e., a rotary kiln, is preferably used. The rotary kiln is preferably operated with the retort rotation speed of 0.5 to 10 rpm; the retort inclination of 0.5 to 4.0°; the inlet hammering frequency of 10 to 300 times/min; and the outlet hammering frequency of 10 to 300 times/min. By employing these operating conditions, especially spherical ferrite particles having a small particle size, a high sphericity and surface uniformity, and a low standard deviation are obtained.

FIG. 1 shows an illustrative diagram of a sintering step employed in the production process according to the present invention. In FIG. 1, 1 denotes a granules supplier; 2, a rotary kiln; 3, a hot section; 4, a heating body; 5, a cooling section; 6, a cooling body; and 7, spherical ferrite particles.

In the production process according to the present invention, the granules may be pre-sintered before the above sintering. The pre-sintering is performed at a pre-sintering temperature of 500 to 700° C. and for a pre-sintering time of 0.1 to 5 h, preferably 0.1 to 4 h, further preferably 0.1 to 2 h. In the pre-sintering, the granules may or may not be made to flow. In the case of making the granules flow, a rotary sintering furnace as the fluidizing means is used as in sintering. For economically producing spherical ferrite particles, classification is performed after granulation to control the granules. However, organic substances such as a binder and an additive are present in the granules, and since if the organic substances are much contained in the granules, the sintering atmosphere gas becomes a reducing gas, and adversely affects the sintering, these organic substances are preferably removed by pre-sintering before a high temperature sintering.

Figure 2:
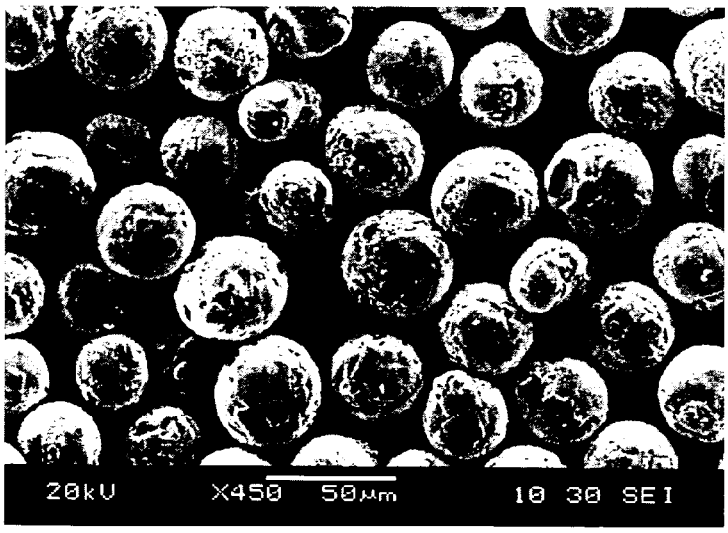
FIG. 2 shows an electron microscope photograph (magnification of ×300) of a sintered material (spherical ferrite particle) according to the present invention.

An electron photograph (magnification of ×300) of the sintered material thus obtained (spherical ferrite particle) is shown in FIG. 2. As shown in FIG. 2, the spherical ferrite particles have a small particle size, and a high sphericity and surface uniformity.

The sintered material obtained by thus sintering is crushed, and classified. The particle size is adjusted into a desired particle size by using an existing pneumatic classifier, mesh filtration method, precipitation method, etc., as a classifying method.

Thereafter, optionally, the oxide film treatment may be performed by heating the surface at a low temperature to control the electric resistance. The oxide film treatment uses a common rotary electric furnace, batch-type electric furnace, etc., and performs a heat treatment at 300 to 700° C. The oxide film thickness formed by this treatment is preferably 0.1 nm to 5 μm. With the thickness of less than 0.1 nm, the effect of the oxide film layer is little; and with that exceeding 5 μm, since the magnetization is reduced, and the resistance becomes too high, troubles such as the decrease in charging capability are liable to occur. Optionally, the reduction may be performed before the oxide film treatment.

A method for coating spherical ferrite particles (carrier core material) described above with a coating resin described above involves coating by a well-known method, for example, brush coating, dry coating, fluidized bed spray dry coating, rotary dry coating and liquid-immersion drying using a universal stirrer. For improving the coating ratio, the method by a fluidized bed is preferable.

For baking the resin after the carrier core material is coated with the resin, either of an external heating system and an internal heating system can be used, and, for example, a fixed-type or flow-type electric furnace, a rotary electric furnace, a burner furnace, or the microwave can be used for baking. The baking temperatures are different depending on the resins to be used, and a temperature of not less than the melting point or the glass transition temperature is needed. For a thermosetting resin, a condensation-crosslinkable resin and the like, the temperature needs to be raised to full curing.

<An Electrophotographic Developer According to the Present Invention>

An electrophotographic developer according to the present invention will be explained.

The electrophotographic developer according to the present invention is composed of the resin-coated carrier described above and a toner.

Toner particles constituting a developer of the present invention include pulverized toner particles produced by the pulverizing method, and polymer toner particles produced by the polymerizing method. In the present invention, the toner particles obtained by either of them can be used.

The pulverized toner particles can be obtained, for example, by fully mixing a binder resin, a charge control agent and a colorant by a mixer such as a Henschel mixer, then melting and kneading by a biaxial extruder, etc., cooling, pulverizing, classifying, adding with additives, and thereafter mixing by a mixer, etc.

The binder resin constituting the pulverized toner particle is not especially limited, but includes a polystyrene, chloropolystyrene, styrene-chlorostyrene copolymer, styrene-acrylate copolymer, styrene-methacrylate copolymer, and further, a rosin-modified maleic acid resin, epoxide resin, polyester resin and polyurethane resin. These are used alone or by mixing.

As the charge control agent, an optional one can be used. A positively chargeable toner includes, for example, a nigrosin dye and a quaternary ammonium salt, and a negatively chargeable toner includes, for example, a metal-containing monoazo dye.

As the colorant (coloring material), conventionally known dyes and pigments are usable. For example, carbon black, phthalocyanine blue, permanent red, chrome yellow, phthalocyanine green and the like can be used. Otherwise, additives such as a silica powder and titania for improving the fluidity and cohesion resistance of the toner can be added corresponding to the toner particles.

The polymer toner particles are produced by a conventionally known method such as suspension polymerization, emulsion polymerization, emulsion coagulation, ester extension polymerization and phase transition emulsion. Such toner particles by the polymerization methods is obtained, for example, by mixing and stirring a colored dispersion liquid in which a colorant is dispersed in water using a surfactant, a polymerizable monomer, a surfactant and a polymerization initiator in an aqueous medium, emulsifying and dispersing the polymerizable monomer in the aqueous medium, and polymerizing while stirring and mixing, and thereafter added with a salting-out agent to salt out polymerized particles. The particles obtained by the salting-out are filtered, washed and dried to obtain polymer toner particles. Thereafter, an additive is optionally added to the dried toner particles.

Further, on producing the polymer toner particles, a fixability improving agent and a charge control agent can be blended other than the polymerizable monomer, surfactant, polymerization initiator and colorant, thus allowing to control and improve various properties of the polymer toner particles obtained using these. Besides, for improving the dispersibility of the polymerizable monomer in the aqueous medium, and adjusting the molecular weight of the obtained polymer, a chain-transfer agent can be used.

The polymerizable monomer used for the production of the above polymer toner particles is not especially limited, but includes, for example, styrene and its derivatives, ethylenic unsaturated monoolefins such as ethylene and propylene, halogenated vinyls such as vinyl chloride, vinylesters such as vinyl acetate, and α-methylene aliphatic monocarboxylate such as methyl acrylate, ethyl acrylate, methyl methacrylate, ethyl methacrylate, 2-ethylhexyl methacrylate, acrylic acid dimethylaminoester and methacrylic acid diethylaminoester.

As the colorant (coloring material) used for preparing the above polymer toner particles, conventionally known dyes and pigments are usable. For example, carbon black, phthalocyanine blue, permanent red, chrome yellow and phthalocyanine green can be used. The surface of colorants may be improved by using a silane coupling agent, a titanium coupling agent and the like.

As the surfactant used for the production of the above polymer toner particles, an anionic surfactant, a cationic surfactant, an amphoteric surfactant and a nonionic surfactant can be used.

Here, the anionic surfactants include sodium oleate, a fatty acid salt such as castor oil, an alkylsulfate such as sodium laurylsulfate and ammonium laurylsulfate, an alkylbenzenesulfonate such as sodium dodecylbenzenesulfonate, an alkylnaphthalenesulfonate, an alkylphosphate, a naphthalenesulfonic acid-formalin condensate, a polyoxyethylene alkylsulfate, etc. The nonionic surfactants include a polyoxyethylene alkyl ether, a polyoxyethylene aliphatic acid ester, a sorbitan aliphatic acid ester, a polyoxyethylene alkyl amine, glycerin, an aliphatic acid ester, an oxyethylene-oxypropylene blockpolymer, etc. Further, the cationic surfactants include alkylamine salts such as laurylamine acetate, and quaternary ammonium salts such as lauryltrimethylammonium chloride, stearyltrimethylammoniumchloride, etc. Then, the amphoteric surfactants include an aminocarbonate, an alkylamino acid, etc.

A surfactant as above is generally used in an amount within the range of 0.01 to 10 wt % to a polymerizable monomer. Since the use amount of such a surfactant affects the dispersion stability of the monomer, and affects the environmental dependability of the obtained polymer toner particles, it is preferably used in the amount within the above range where the dispersion stability of the monomer is secured, and the polymer toner particles do not excessively affect the environmental dependability.

For the production of the polymer toner particles, a polymerization initiator is generally used. The polymerization initiators come in a water-soluble polymerization initiator and an oil-soluble polymerization initiator, and both of them can be used in the present invention. The water-soluble polymerization initiator usable in the present invention includes, for example, a peroxosulfate salt such as potassium peroxosulfate, and ammonium peroxosulfate, and a water-soluble peroxide compound. The oil-soluble polymerization initiator includes, for example, an azo compound such as azobisisobutyronitrile, and an oil-soluble peroxide compound.

In the case where a chain-transfer agent is used in the present invention, the chain-transfer agent includes, for example, mercaptans such as octylmercaptan, dodecylmercaptan and tert-dodecylmercaptan, carbon tetrabromide, etc.

Further, in the case where polymer toner particles used in the present invention contain a fixation improving agent, as the fixation improving agent, a natural wax such as a carnauba wax, and an olefinic wax such as a polypropylene and a polyethylene can be used.

In the case where polymer toner particles used in the present invention contain a charge control agent, the charge control agent to be used is not especially limited, and a nigrosine dye, a quaternary ammonium salt, an organic metal complex, a metal-containing monoazo dye and the like can be used.

The additive used for improving the fluidity, etc., of polymer toner particles includes silica, titanium oxide, barium titanate, fluorine microparticles, acrylic microparticles, etc., and these can be used alone or in combination thereof.

Further, the salting-out agent used for separating polymer particles from an aqueous medium includes metal salts such as magnesium sulfate, aluminum sulfate, barium chloride, magnesium chloride, calcium chloride and sodium chloride.

The average particle size of the toner particles produced as above is in the range of 2 to 15 μm, preferably in the range of 3 to 10 μm. The polymer toner particles have higher uniformity than in the pulverized toner particles. The toner particles of less than 2 μm decrease the charging capability and are liable to bring about the fogging in image and toner scattering. That exceeding 15 μm causes the degradation of image quality.

By mixing the carrier and the toner produced as above, an electrophotographic developer is obtained. The mixing ratio of the carrier to the toner, namely, the toner concentration, is preferably set to be 3 to 15%. With less than 3%, a desired image density is hard to obtain. With more than 15%, the toner scattering and fogging in image are liable to occur.

The developer mixed as above can be used in copiers, printers, FAXs, printing presses and the like, in the digital system, which use the development system in which electrostatic latent images formed on a latent image holder having an organic photoconductor layer are reversal-developed by a magnetic brush of the two-component developer having the toner and the carrier while impressing a bias electric field. It is also applicable to full-color machines and the like which use an alternating electric field, which is a method to superpose an AC bias on a DC bias, when the developing bias is applied from the magnetic brush to the electrostatic latent image side.

Hereinafter, the present invention will be specifically explained by way of examples.

Example 1

Iron oxide (50 mol %), manganese oxide (40 mol %) and magnesium oxide (10 mol %) based on a total amount of oxides were weighed, mixed and crushed to obtain a crushed material; thereafter water of 25 L was added to an attritor; and the crushed material was further crushed for 1 h to prepare a slurry of a solid content of 50%. The prepared slurry was granulated by a spray drier to obtain spherical granules.

The granules were calcined in a rotary kiln at 900° C. After the calcination, 20 kg of the granules, 20 L of water, 128 g (10% solution of polyvinyl alcohol) of a binder and 100 g (ammonium polycarboxylate) of a dispersant were together crushed in an attritor for 2 h to obtain a slurry having a solid content of 50%. The fabricated slurry was granulated by a spray drier to obtain spherical granules of 38 μm in average particle size.

The granules were pre-sintered in a rotary kiln at 700° C. for 0.5 h to remove organic substances such as the binder. Then, the pre-sintered granules were fed to a rotary kiln whose hot section was set at 1,320° C. to further sinter for 1.5 h. In the sintering, a nitrogen-mixed gas adjusted to an oxygen concentration of 4.5% is fed at a flow rate of 50 L/min to the rotary kiln. The operating conditions and the feeding amount of the ferrite granules are as follows.

The retort rotation speed of the rotary kiln: 3 rpm.

The retort inclination of the rotary kiln: 0.5°.

The feeding amount of the ferrite granules to be sintered: 3 kg/h.

The inlet hammering frequency: 30 times/min.

The outlet hammering frequency: 20 times/min.

After the sintering, the obtained sintered material was shredded in a jet mill, and classified to obtain spherical ferrite particles of 35 μm in average particle size. The results obtained by the measurements described later of the physical properties such as shape and sphericity of the spherical ferrite particles are shown in Table 1.

An acryl-modified silicone resin (KR-9706 (tradename)), manufactured by Shin-Etsu Chemical Co., Ltd., was diluted in toluene; and the above spherical ferrite particles (ferrite core material) were coated with the obtained dilution in an amount of 0.5 wt % using a fluidized bed coating apparatus, thereafter baked at 230° C. for 1 h, cooled, and shredded to obtain a resin-coated carrier. Evaluations by actual machines were conducted using the obtained resin-coated carrier. The results are shown in Table 2.

Example 2

A slurry having a solid content of 50% was obtained as in Example 1, and then spherical granules of 27 μm in average particle size were obtained by a spray drier. The granules were pre-sintered in a rotary kiln at 700° C. for 0.5 h to remove organic substances such as the binder. Then, the pre-sintered granules were fed to a rotary kiln whose hot section was set at 1,320° C., and further sintered for 1.5 h. In sintering, a nitrogen-mixed gas adjusted to an oxygen concentration of 4.5% was fed to the rotary kiln at a flow rate of 50 L/min. The operating conditions of the rotary kiln and the feeding amount of the ferrite granules were similar to Example 1.

After the sintering, the obtained sintered material was shredded by a jet mill, and classified to obtain spherical ferrite particles of 25 μm in average particle size. The results obtained by the measurements described later of the physical properties such as shape and sphericity of the spherical ferrite particles are shown in Table 1. After the above obtained spherical ferrite particles (ferrite core material) were coated with a resin as in Example 1, evaluations by actual machines were conducted using the obtained resin-coated carrier as in Example 1. The results are shown in Table 2.

Example 3

A slurry of a solid content of 50% was obtained as in Example 1, and then spherical granules of 38 μm in average particle size were obtained by a spray drier. The granules material, without being pre-sintered, were directly sintered in a rotary kiln set at 1,320° C. for 0.5 h. In sintering, a nitrogen-mixed gas adjusted to an oxygen concentration of 15% was fed to the rotary kiln at a flow rate of 50 L/min.

After the sintering, the obtained sintered material was shredded by a jet mill, and classified to obtain spherical ferrite particles of 35 μm in average particle size. The results obtained by the measurements described later of the physical properties such as shape and sphericity of the spherical ferrite particles are shown in Table 1. After the above obtained spherical ferrite particles (ferrite core material) were coated with a resin as in Example 1, evaluations by actual machines were conducted using the obtained resin-coated carrier as in Example 1. The results are shown in Table 2.

Comparative Example 1

After spherical granules of 38 μm in average particle size granulated as in Example 1 were prepared, the granules were charged with a sagger, and sintered in a tunnel-type electric sintering furnace at a sintering temperature of 1,310° C. for 5 h. In sintering, a nitrogen-mixed gas adjusted to an oxygen concentration of 4.5% was fed to the tunnel-type electric sintering furnace at a flow rate of 90 L/min. After the sintering, the obtained sintered material was shredded by a jet mill, and classified to obtain spherical ferrite particles of 35 μm in average particle size.

The results obtained by the measurements described later of the physical properties such as shape and sphericity of the spherical ferrite particles are shown in Table 1. After the above obtained spherical ferrite particles (ferrite core material) were coated with a resin as in Example 1, evaluations by actual machines were conducted using the obtained resin-coated carrier as in Example 1. The results are shown in Table 2.

Comparative Example 2

Spherical granules of 27 μm in average particle size granulated as in Example 2 were pre-sintered in a rotary kiln at 700° C. for 0.5 h to remove organic substances such as a binder. Next, as in Comparative Example 1, the sintered granules were charged with a sagger, and further sintered in a tunnel-type electric sintering furnace at a sintering temperature of 1,310° C. for 5 h. In sintering, a nitrogen-mixed gas adjusted to an oxygen concentration of 4.5% was fed to the tunnel-type electric sintering furnace at a flow rate of 50 L/min.

After the sintering, the obtained sintered material was shredded by a jet mill, and classified to obtain spherical ferrite particles of 25 μm in average particle size. The results obtained by the measurements described later of the physical properties such as shape and sphericity of the spherical ferrite particles are shown in Table 1. After the above obtained spherical ferrite particles (ferrite core material) were coated with a resin as in Example 1, evaluations by actual machines were conducted using the obtained resin-coated carrier as in Example 1. The results are shown in Table 2.

Comparative Example 3

Spherical granules of 27 μm in average particle size granulated as in Comparative Example 2 were charged with a sagger, and sintered in a tunnel-type electric sintering furnace at a sintering temperature of 1,250° C. for 5 h. In sintering, a nitrogen-mixed gas adjusted to an oxygen concentration of 4.5% was fed to the tunnel-type electric sintering furnace at a flow rate of 90 L/min.

After the sintering, the obtained sintered material was shredded by a jet mill, and classified to obtain spherical ferrite particles of 25 μm in average particle size. The results obtained by the measurements described later of the physical properties such as shape and sphericity of the spherical ferrite particles are shown in Table 1. After the above obtained spherical ferrite particles (ferrite core material) were coated with a resin as in Example 1, evaluations by actual machines were conducted using the obtained resin-coated carrier as in Example 1. The results are shown in Table 2.

Comparative Example 4

Spherical granules of 38 μm in average particle size granulated as in Example 1 were fed to a rotary kiln whose hot section was set at 1,150° C., and sintered for 5 h. In sintering, a nitrogen-mixed gas adjusted to an oxygen concentration of 4.5% was fed to the rotary kiln at a flow rate of 50 L/min. The operating conditions of the rotary kiln and the feeding amount of the ferrite granules were similar to Example 1.

After the sintering, the obtained sintered material was shredded by a jet mill, and classified to obtain spherical ferrite particles of 35 μm in average particle size. The results obtained by the measurements described later of the physical properties such as shape and sphericity of the spherical ferrite particles are shown in Table 1. An acryl-modified silicone resin (KR-9706 (trade name)), manufactured by Shin-Etsu Chemical Co., Ltd., was diluted in toluene; and the above spherical ferrite particles (ferrite core material) were coated with the obtained dilution in an amount of 0.5 wt % using a fluidized bed coating apparatus, thereafter baked at 230° C. for 1 h, cooled, and shredded to obtain a resin-coated carrier. Evaluations by actual machines were conducted using the obtained resin-coated carrier. The results are shown in Table 2.

[Property Evaluations of Spherical Ferrite Particles (Carrier Core Material)]

1. Average Particle Size:

The average particle size was measured using a laser diffraction-type particle size distribution measuring instrument "HELOS SYSTEM", manufactured by Japan Laser Corp.

2. Apparent Density (AD):

The apparent density was measured according to JIS-Z2504 (Metallic powders-Determination of apparent density-Funnel method).

3. Surface Uniformity:

(1) A carrier core material is photographed by a SEM (scanning electron microscope) at a magnification of ×200 by shifting the visual field so that the total number of more than 200 particles can be counted.

(2) The carrier core material whose surface has a smooth part occupying a half or more of the surface is visually checked.

(3) One hundred particles of the carrier core material are checked, and the percentage content of the carrier core material shown in the above (2) is calculated.

4. Average Sphericity and Sphericity Standard Deviation:

(1) A carrier core material is photographed by a SEM at a magnification of ×300 by shifting the visual field so that the total number of more than 100 particles can be counted.

(2) SEM images are read by a scanner; the image analysis is conducted using an image analyzer soft (Image-Pro PLUS, manufactured by Media Cybernetics Inc.); and the circumscribed circle diameter and the inscribed circle diameter of each particle are determined, and the sphericity is let denote the ratio. If the two diameters are equal, the ratio is 1, and in the case of a true sphere, the ratio is 1.

(3) The average sphericity and its standard deviation are calculated from the sphericities determined for 100 particles.

5. Saturation Magnetization:

The magnetization was read in a magnetic field of 238.7 kA/m by a direct current magnetization property automatic recording instrument (BHU-60, manufactured by Riken Denshi Co., Ltd.) (unit: $Am^2/kg$).

6. Scattered Material Magnetization:

(1) Before a carrier core material is set on a magnetic brush, the above magnetization of the carrier core material (main body magnetization) was measured in a magnetic field of 79.5 A/m by a vibration-type magnetization measuring instrument VSM (manufactured by Toei Kogyo Co., Ltd.).

(2) The carrier core material of 500 g was set on the magnetic brush, and forcibly made to scatter from the magnetic brush by rotating the magnetic brush at a rotation speed of 250 rpm for 5 min.

(3) Then, the scattered carrier core material was collected, and measured for the magnetization in a magnetic field of 79.5 A/m by the vibration-type magnetization measuring instrument VSM (manufactured by Toei Kogyo Co., Ltd.) to compare with the main body magnetization (unit: $Am^2/kg$).

[Toner Preparation]

A polyester resin obtained by condensing propoxylated bisphenol and fumaric acid of 100 parts by weight, a phthalocyanine pigment of 4 parts by weight and a chromium complex of di-tert-butyric acid of 4 parts by weight as raw materials were fully pre-mixed by a Henschel mixer, and melted and kneaded by a biaxially extruding kneader; and the obtained kneaded material was cooled, thereafter coarsely pulverized into about 1.5 mm by a hammer mill, and then finely pulverized by a jet mill to obtain a finely pulverized material.

Further, the obtained finely pulverized material was classified to obtain a cyan powder having a weight average particle size of 8.6 μm. The powder of 100 parts by weight and titanium oxide of 0.05 μm in average particle size of 1 part by weight were mixed by a Henschel mixer to obtain a cyan toner 1.

[Evaluations by Actual Machines]

Each resin-coated carrier and the cyan toner 1 fabricated as described above were mixed such that the toner concentration [(toner weight/developer (toner+carrier) weight)×100]=8% to fabricate a developer, which was charged with a developing machine, and set on the body of a full-color copier "ARC-160 (trade name)", manufactured by Sharp Corp., (the developer filling amount was 630 g). The image quality evaluations of sheets at an early stage of copying (the first sheet to the 13th sheet) and one hundred thousandth sheet were conducted by the methods described below to evaluate each developer. Each result is shown in Table 2.

(1) Image Density

Copying was performed under an optimum exposure condition to evaluate the ID (image density). The image densities of the solid part were measured by a densitometer X-Rite (registered trade name, manufactured by Nippon Lithograph Inc.), and ranked as follows.

E: very excellent
G: in the range of a target image density
M: rather slightly low in image density, but usable
P: below a target lower limit
VP: very low in image density, and unusable (2) Fogging in Image A paper pace (a value for a paper before copying) was previously measured using the X-Rite (registered trade name) as in the image density measurement; the white ground after the copying was measured; and the fogging in image was determined by the expression: the density after copying−the paper pace=fogging, and ranked as follows.

E: less than 0.5
G: 0.5 to 1.0
M: 1.0 to 1.5
P: 1.5 to 2.5
VP: 2.5 or more (3) Carrier Scattering Ten sheets were copied in letratone in an early stage copying and after copying of one hundred thousand sheets of A3 paper, respectively; and the number of white spots in the ten sheets was counted, and ranked as follows.

E: no white spots
G: 1 to 5 spots
M: 6 to 10 spots
P: 11 to 20 spots
VP: 21 or more spots (4) Toner Scattering The toner scattering around the developing machine was visually confirmed, and ranked as follows.

E: not at all observed
G: confirmed to be in a quite small amount
M: on a limit (usable) level
P: much
VP: remarkably much (5) Horizontal Narrow Line Reproducibility The horizontal narrow line reproducibility was visually judged, and ranked as follows.

E: very excellently reproduced
G: almost reproduced
M: on a limit (usable) level
P: remarkably disconnected and blurred
VP: not at all reproduced (6) Half Tone Uniformity The copied half tone was visually judged, and ranked as follows.

E: very uniform and no unevenness
G: uniform and no unevenness
M: slightly uneven, but on a limit (usable) level
P: remarkably uneven and nonuniform
VP: very much uneven and nonuniform

TABLE 1

| Example-Comparative Example | Average particle size (μm) | Apparent density (g/cm$^3$) | Surface uniformity (%) | Average sphericity (%) | Sphericity standard deviation | Saturation magnetization (Am$^2$/kg) | Scattered material magnetization (Am$^2$/kg) | Scattered material/ main body (%) |
|---|---|---|---|---|---|---|---|---|
| Example 1 | 35 | 2.35 | 96 | 1.17 | 0.1137 | 60 | 56 | 93 |
| Example 2 | 25 | 2.21 | 92 | 1.21 | 0.1246 | 60 | 54 | 90 |
| Example 3 | 35 | 2.15 | 90 | 1.29 | 0.1434 | 50 | 44 | 88 |
| Comparative Example 1 | 35 | 2.26 | 75 | 1.26 | 0.1666 | 61 | 40 | 66 |
| Comparative Example 2 | 25 | 2.21 | 80 | 1.23 | 0.1707 | 62 | 45 | 73 |
| Comparative Example 3 | 25 | 2.15 | 71 | 1.31 | 0.1771 | 63 | 41 | 65 |
| Comparative Example 4 | 35 | 1.87 | 7 | 1.18 | 0.1134 | 64 | 56 | 88 |

TABLE 2

| | Item | Example 1 | Example 2 | Example 3 | Comparative Example 1 | Comparative Example 2 | Comparative Example 3 | Comparative Example 4 |
|---|---|---|---|---|---|---|---|---|
| Early stage | Image density | E | E | G | G | M | M | M |
| | Fogging in image | E | E | G | M | M | P | VP |
| | Toner scattering | E | E | G | M | M | M | M |
| | Carrier scattering | E | G | M | M | VP | P | P |
| | Horizontal narrow line reproducibility | G | E | G | P | P | P | VP |
| | Half tone uniformity | E | G | E | M | M | P | VP |
| At the time of 100,000-sheet continuous printing | Image density | E | E | G | M | M | M | P |
| | Fogging in image | E | G | E | M | P | P | VP |
| | Toner scattering | E | E | G | G | P | M | VP |
| | Carrier scattering | E | G | M | M | P | P | M |

TABLE 2-continued

| Item | Example 1 | Example 2 | Example 3 | Comparative Example 1 | Comparative Example 2 | Comparative Example 3 | Comparative Example 4 |
|---|---|---|---|---|---|---|---|
| Horizontal narrow line reproducibility | E | E | M | P | P | P | P |
| Half tone uniformity | G | G | G | M | P | P | VP |

As clarified from Table 1 and Table 2, Examples 1 to 3 wherein the ferrite particles which are obtained by sintering the granules at 1,200° C. or more while being made to flow by a fluidizing means, and which have average particle sizes, surface uniformities, average sphericities and sphericity standard deviations in high levels are coated with the resin, exhibit that any of the image density, fogging in image, toner scattering, carrier scattering, horizontal narrow line reproducibility and half tone uniformity is satisfactory at an early period and an elapsed time (after 100,000-sheet continuous printing) when used as a developer. By contrast, Comparative Examples 1 to 4 wherein the ferrite particles which are obtained by sintering by a method other than the above method and which are inferior in the surface uniformity, sphericity standard deviation, etc., are coated with the resin, exhibit low image qualities and especially inferior horizontal narrow line reproducibility at an early period and an elapsed time (after 100,000-sheet continuous printing) in comparison with Examples 1 to 3.

INDUSTRIAL APPLICABILITY

The resin-coated carrier for an electrophotographic developer according to the present invention is one in which a carrier core material having a small particle size, a high sphericity and surface uniformity and a low standard deviation is coated with a resin without generating the coating unevenness and core material exposure and in which the carrier scattering is little. Such resin-coated carrier can be produced in a stable productivity by the production process according to the present invention. Since the electrophotographic developer according to the present invention using the above resin-coated carrier provides a high-quality image and is excellent in durability as well, it is widely usable especially in fields of full-color machines requiring high-quality images and high-speed machines requiring reliability and durability of image sustainability.

The invention claimed is:

1. A process for producing a resin-coated carrier for an electrophotographic developer, the process comprising mixing ferrite raw materials, crushing the mixture, granulating the obtained crushed mixture to produce granules, pre-sintering the granules at 500 to 700° C., sintering the granules for 0.1 to 5 hours at a sintering temperature of 1200 to 1400° C. under fluidization, and coating the sintered material, with a resin.

2. The process for producing a resin-coated carrier for an electrophotographic developer according to claim 1, wherein the granules are sintered in a rotary sintering furnace.

3. The process for producing a resin-coated carrier for an electrophotographic developer according to claim 2, wherein the rotary sintering furnace has a retort rotation speed of 0.5 to 10 rpm, a retort inclination of 0.5 to 4°, an inlet hammering frequency of 10 to 300 times/min, and an outlet hammering frequency of 10 to 300 times/min.

* * * * *